US009650833B2

(12) United States Patent
McGinn, Jr. et al.

(10) Patent No.: US 9,650,833 B2
(45) Date of Patent: May 16, 2017

(54) PORTABLE MODULAR EARTH BORING MACHINE

(71) Applicants: Robert M. McGinn, Jr., Travelers Rest, SC (US); Robert W. Cummins, Jr., Travelers Rest, SC (US); Darrell G. Payne, Jr., Travelers Rest, SC (US)

(72) Inventors: Robert M. McGinn, Jr., Travelers Rest, SC (US); Robert W. Cummins, Jr., Travelers Rest, SC (US); Darrell G. Payne, Jr., Travelers Rest, SC (US)

( * ) Notice: Subject to any disclaimer, the term of this patent is extended or adjusted under 35 U.S.C. 154(b) by 859 days.

(21) Appl. No.: 14/010,853

(22) Filed: Aug. 27, 2013

(65) Prior Publication Data

US 2015/0060147 A1 Mar. 5, 2015

(51) Int. Cl.
*E21B 7/00* (2006.01)

(52) U.S. Cl.
CPC ..... *E21B 7/006* (2013.01)

(58) Field of Classification Search
CPC ..... E21B 7/005; E21B 7/006; E21B 7/062; E21B 7/201; E21B 7/203
See application file for complete search history.

(56) References Cited

U.S. PATENT DOCUMENTS 3,856,093 A * 12/1974 Case ..... E21B 7/005 173/152
3,886,999 A 6/1975 Appleman
3,907,043 A 9/1975 Appleman
3,939,926 A 2/1976 Barnes
4,042,043 A 8/1977 Appleman
4,047,578 A * 9/1977 Appleman ..... E21B 7/201 173/152
4,538,858 A 9/1985 Kilgour
4,553,612 A 11/1985 Durham
5,386,878 A * 2/1995 Rowekamp ..... E21B 7/203 175/62
5,810,101 A * 9/1998 Caraway, Jr. ..... E21B 7/005 173/185
7,708,072 B1 * 5/2010 Hunziker ..... E21B 19/06 166/301
2010/0065331 A1 * 3/2010 Harrison ..... E21B 7/201 175/57

* cited by examiner

*Primary Examiner* — Giovanna C Wright
*Assistant Examiner* — Kristyn Hall
(74) *Attorney, Agent, or Firm* — Southeast IP Group, LLC.; Thomas L. Moses; Randolph J. Tucker

(57) ABSTRACT

A portable modular horizontal earth boring machine includes three main components: a digging mechanism, a discharge mechanism and a driving mechanism. The digging mechanism includes an auger and a rigid sleeve positioned around the auger. The driving mechanism and the discharge mechanism are positioned within an outer housing. The driving mechanism spins the drive shaft and the auger, and the discharge mechanism includes discharge paddles that rotate, causing dirt and debris that is generated during a boring operation to be expelled from the discharge mechanism through a discharge port. The auger and sleeve are removably connected to the machine, so that it may be disassembled for transport and storage.

12 Claims, 4 Drawing Sheets

PORTABLE MODULAR EARTH BORING MACHINE

BACKGROUND OF THE INVENTION

The present invention relates generally to machines used to bore holes and tunnels underneath roads, driveways and the like for the purpose of installing plumbing and electrical conduits and other utility equipment. More specifically, the present invention includes a low-profile, portable modular boring machine that may be broken down into several component parts for purposes of transport and storage.

Many different types of earth boring machines are used to dig tunnels and ditches, particularly underneath roads and driveways, in order to install water lines, electrical lines, and other types of utility equipment. Such machines are useful for this type of work, because it obviates the need to break up sections of road, driveway, or other types of installed surfaces while the work is being performed. Years ago, if it was necessary to install a water line, for instance, beneath a road surface, workers would be required to use jackhammers and other tools of destruction to break up a section of the road. Then, workers would dig a ditch, install the water line, refill the ditch, and repair the road surface. This method was extremely inconvenient, because the work would disrupt road traffic while the work was taking place. More recently, earth boring machines have been developed that are used to simply dig a hole or tunnel underneath a road (or similar surface), which allows the work to take place without disrupting the road surface, and traffic as well, in the process. While these earth boring machines are an improvement over the earlier method of breaking up the road for such installation, they still have problems and disadvantages of their own.

U.S. Pat. No. 3,886,999, issued to Appleman, is directed to a portable earth boring machine for the horizontal boring of shafts and the insertion of pipeline casing sections in installations where excavation from the surface is undesirable. The machine is characterized by vertically adjustable auger drive means which permit the selective location of the axes of the auger drive shafts at various elevations such that augers of various diameters can be utilized without the necessity of excessively deep excavations for the installation of the machine and its track when pipe lines of smaller diameter are to be installed. The machine is further characterized by casing pusher ring apparatus arranged to selectively accommodate casing pusher rings of various diameters so as to conform with the selected size of the boring auger being used during the particular boring operation.

U.S. Pat. No. 3,907,043 describes a portable earth boring machine for the horizontal boring of shafts and the insertion of pipeline casing sections, similarly to the '999 patent listed above.

U.S. Pat. No. 3,939,926 discloses a portable earth boring machine characterized by a steering head particularly adapted for rock drilling operations which head is positioned at the front of the casing with such steering head being automatically controlled so as to directionally control the direction of extension of the pipeline as the drilling operation progresses.

U.S. Pat. No. 4,042,043 is directed to a portable earth boring machine characterized by frame means adapted for movement along a track means, which frame means supports an engine which drives an earth boring auger as well as casing pusher apparatus for pushing casing sections into the earth fill as the boring operation progresses. The machine is further characterized by a fluid actuated pusher cylinder means for advancing the auger into the earth fill and associated automatic auger feed control means for automatically maintaining a constant fluid flow rate to said pushing cylinder means under variations in resistance to auger penetration of said earth fill during a boring operation.

U.S. Pat. No. 4,538,858 discloses a horizontal earth boring machine in which a carriage supports an engine rotatably connected to an auger, and a push ring. The carriage is movable along a set of tracks between a forward position and a rearward position. Hydraulic means power the carriage between its forward and rearward positions. In one version, the auger and push ring are connected by a universal joint to the engine so that a pair of hydraulic cylinders can raise the push ring and planetary gear reduction unit to an adjusted position above the track in order to accommodate any vertical misalignment of the push ring as it is pushing pipe through a horizontal hole drilled by the auger.

U.S. Pat. No. 4,533,612 is directed to an earth boring machine for boring straight and level elongated holes through rock-laden earth. The machine includes a stationary elongated frame upon which a first slide is carried. A second slide is carried on the first slide. An elongated auger guiding sleeve is carried adjacent one end of the first slide and has a cutting edge on a remote end thereof. A power-driven auger assembly is carried on the second slide and includes an auger which extends within the guiding sleeve. A cutting tool is carried on the end of the auger adjacent a remote end of the guiding sleeve. A hydraulic cylinder is provided for advancing the first sleeve for driving the cutting edge of the guiding sleeve into the earth while the power driven auger removes the earth as the guiding sleeve is advanced. Another set of hydraulic cylinders are provided for advancing the second slide on the first slide causing the cutting tool to extend out beyond the remote end of the guiding sleeve for cutting through obstructions in the earth when the cutting edge of the guiding sleeve is prevented from moving forward.

U.S. Pat. No. 5,810,101 describes a digger for digging utility pole holes, wherein the digger is encased in an elongated box. The box has an attachment thereon for attachment to the carrying arm of a backhoe in place of the backhoe bucket. A 90° attachment provides versatility. The digger is capable of digging horizontal tunnels for laying one underground line under another underground line.

Each of the references cited above is hereby incorporated herein by reference. Unfortunately, each of these machines has disadvantages and drawbacks. Many are large, bulky and awkward, and have a large footprint, which makes them difficult to use in areas where there are bushes or other obstructions near the work area. Some require the use of large machinery, such as an excavator, which in itself is difficult and expensive to operate. Therefore, it would be desirable to provide a low profile, portable, horizontal earth boring machine of modular construction with a small footprint, which can be easily assembled on site for use, and which can be easily disassembled for transport, for instance, on a small trailer.

Additionally, in order to bore a horizontal hole under a road or driveway, it is generally necessary to dig a hole adjacent the roadway where the boring machine may be placed. Because the boring operation is generally horizontal, the hole next to the roadway must be large enough for the boring machine, plus the length of the tracks to fit into. For this reason, it is desirable to provide a small, portable horizontal boring machine, in order to minimize the size of the ditch in which the boring machine must be positioned for the boring operation.

BRIEF SUMMARY OF THE INVENTION

In accordance with one aspect of the invention, a portable, modular, low profile horizontal earth boring machine includes three primary components: a digging mechanism, a discharge mechanism and a driving mechanism. The digging mechanism includes an auger, and during use, the auger is positioned within a rigid sleeve that is slightly larger than the diameter of the auger, so that the auger may spin within the sleeve. At the distal end of the auger is a cutter or boring head having a diameter slightly larger than the diameter of the sleeve. The auger and sleeve are removably connected to the driving mechanism, which in a preferred embodiment includes a drive housing that houses a hydraulic drive. The auger is operationally connected to the hydraulic drive, which turns the auger within the sleeve during operation. The hydraulic drive is positioned in a rear portion of the drive housing. The hydraulic drive is connected to a coupling, which in turn is connected to a drive shaft that extends through the front of the drive housing and drives the auger.

The discharge mechanism is positioned in a front portion of the drive housing within a generally tubular shaped discharge hopper, in a preferred embodiment, wherein a pair of discharge paddles are attached to the drive shaft. A discharge ramp is positioned adjacent the discharge paddles within the discharge hopper, and the discharge ramp extends outwardly toward one side of the drive housing, where an open discharge port is located.

During operation, the auger spins, boring a horizontal hole in the ground, and pulls the dirt, rocks and rubble toward the drive housing through the sleeve. When the dirt and rocks enter the drive housing into the discharge hopper, the discharge paddles force the dirt and rocks out of the drive housing via a discharge ramp, which directs the dirt and rock outwardly through a discharge port.

BRIEF DESCRIPTION OF THE DRAWINGS

These and other features, aspects, and advantages of the present invention will become better understood with regard to the following description, appended claims, and accompanying drawings where:

DETAILED DESCRIPTION OF THE INVENTION

Figure 1:
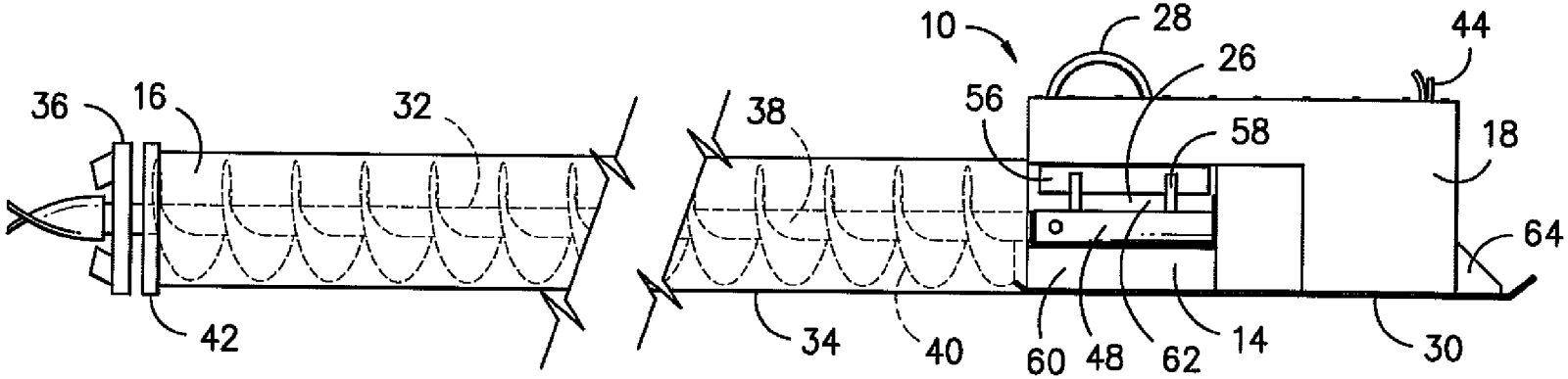
FIG. 1 is a cut-away side view of one embodiment of a portable modular earth boring machine in accordance with the present invention.

The present invention includes, in a first embodiment, a portable modular horizontal earth boring machine 10 having a driving mechanism 12, a discharge mechanism 14 and a digging mechanism 16. The discharge mechanism 14 and digging mechanism 16 are housed within an drive housing 18. The drive housing 18 includes a frame 20 on the inside thereof, and the frame 20 includes supports 22 that hold the driving mechanism 12, which is preferably in the form of a hydraulic drive 24, as well as the discharge hopper 26, in place. An extraction ring 28 is positioned on the outside of the drive housing 18, which can be used for attachment to a cable or other equipment to pull the machine 10 back out of the hole after a boring operation. The drive housing 18 may also include a skid plate 30 on an underside thereof, and the skid plate 30 may have front and/or back edges that are turned upwardly, for sliding across the ground while the boring operation is underway.

Figure 2:
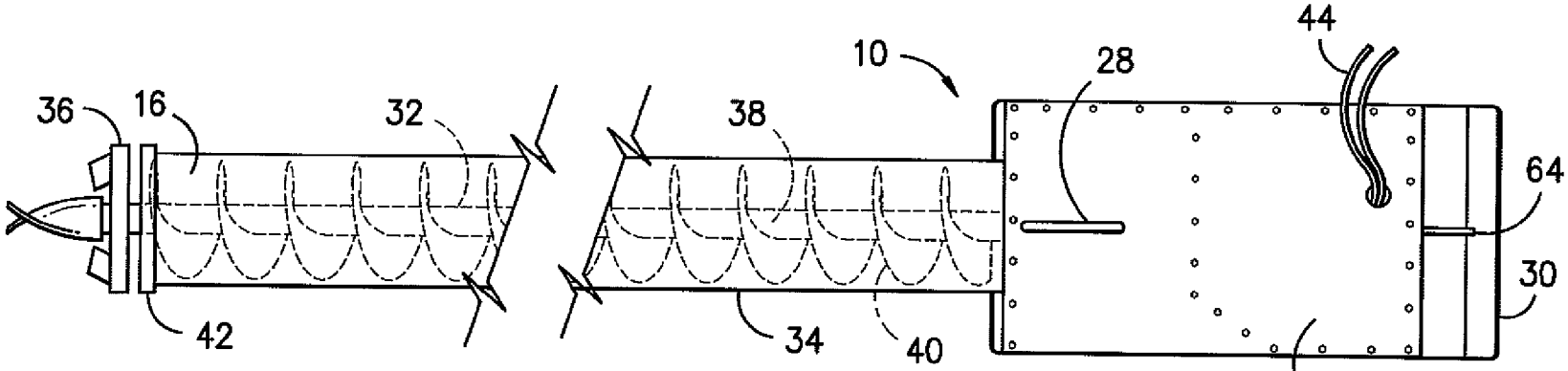
FIG. 2 is a cut-away top view of one embodiment of a portable modular earth boring machine in accordance with the present invention.
Figure 3:
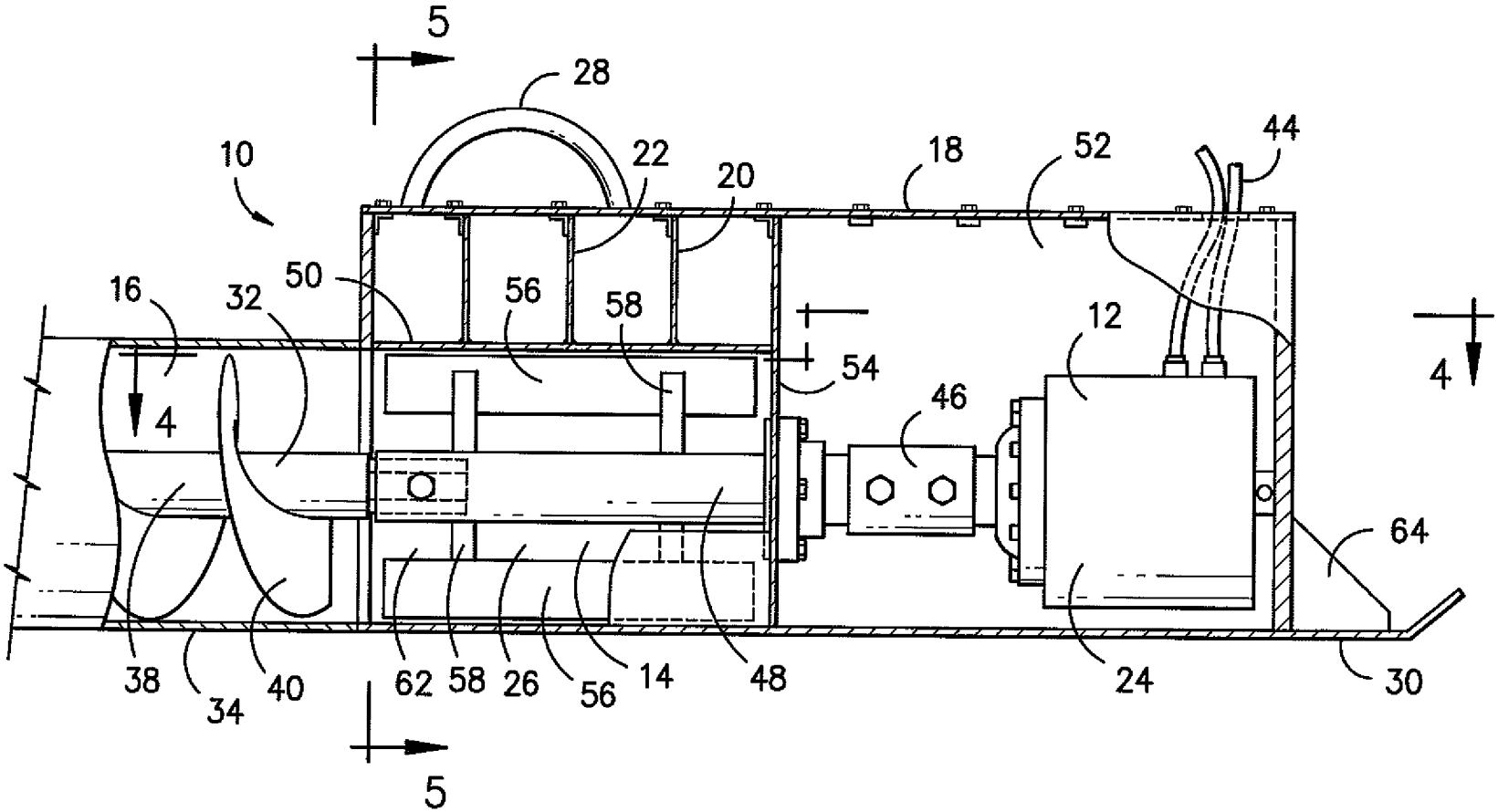
FIG. 3 is a cut-away side view of one embodiment of the drive mechanism and discharge mechanism of a portable modular earth boring machine in accordance with the present invention.
Figure 4:
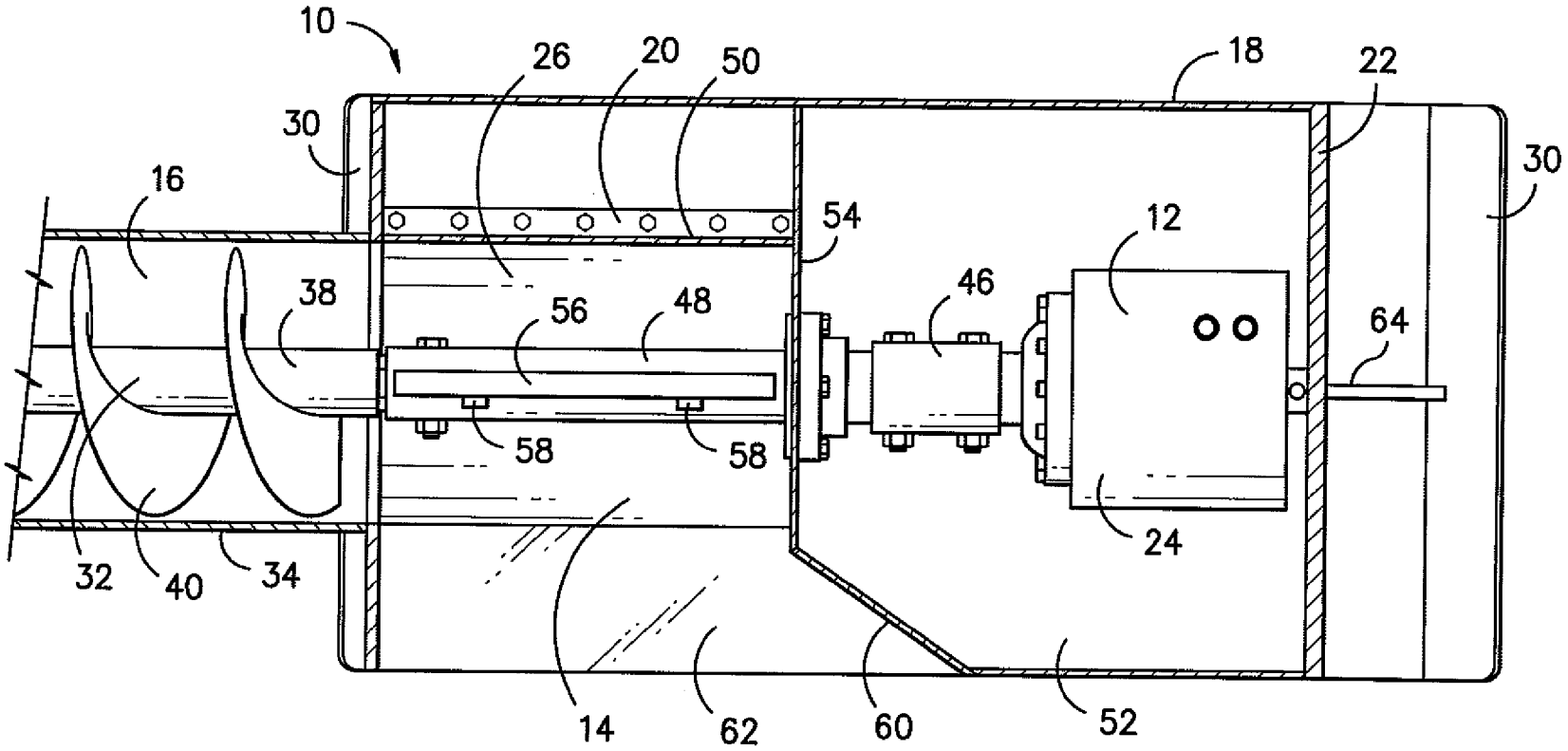
FIG. 4 is a cut-away top view of one embodiment of the driving mechanism and discharge mechanism of a portable modular earth boring machine in accordance with the present invention.

As shown in FIGS. 1 and 2, the digging mechanism 16 includes an auger 32 disposed within a rigid sleeve 34 so that the auger 32 may spin within the sleeve 34 during a boring operation. The diameter of the sleeve 34 is slightly larger than the diameter of the auger 32, allowing the auger 32 to spin therein and to pull dirt, rock and debris through the sleeve 34 toward the discharge mechanism 14. As illustrated in FIGS. 1 and 2, the distal end of the auger 32 includes a boring head 36 having a diameter slightly larger than the diameter of the sleeve 34, so that when the boring head 36 creates the initial hole for the bore, the sleeve 34 may fit into the hole and penetrate further into the bore during the boring operation. In a preferred embodiment, the sleeve 34 has a diameter of approximately 12 inches, although it is contemplated that other sizes may be used. The auger 32 includes an auger shaft 38 having spiraling auger vanes 40 disposed along the shaft 38, as shown. A casing relief band 42 may be positioned around the outside of the sleeve 34 at a distal end thereof, adjacent the boring head 36, in order to provide additional strength and rigidity, as well as providing relief for the remainder of the sleeve to travel through.

The auger 32 is rotated by the driving mechanism 12, which, in a preferred embodiment, includes a hydraulic drive 24. Although a hydraulic drive 24 is the preferred embodiment, it is contemplated that other types of drives may be used, including electric, gas, diesel, pneumatic, or any other type of drive that provides enough power to run the auger 32 during a boring operation. The hydraulic drive 24 is positioned in a rear portion of the drive housing 18 within a drive chamber 52, and includes a pair of hydraulic hoses 44, that may be attached to an external hydraulic power source or pump, which are commonly found on most types of tractors having a hydraulic hook-up mechanism. Alternatively, a hydraulic power pack or any other type of suitable hydraulic power source may be used to power the hydraulic drive, as well. The drive 24 is operatively connected to a coupling 46, which receives a drive shaft 48 that extends away from the drive 24 and through the discharge hopper 26. The auger 32 is removably attached to the end of the drive shaft 48, preferably by a bolt that extends through holes in the drive shaft 48 and one end of the auger 32, which fit together in a male/female or telescopic relation, in a preferred embodiment. Other attachment means may be employed to facilitate removable attachment of the auger 32 to the drive shaft 48, if desired. Additionally, the sleeve 34 is removably attached to the drive housing 18, and remains in a fixed position. The sleeve 34 fits over an opening in the drive housing 18, and the opening provides access to the discharge hopper 26, so that the dirt and debris that flows through the sleeve 34 passes through the opening and into the discharge hopper 26.

Figure 5:
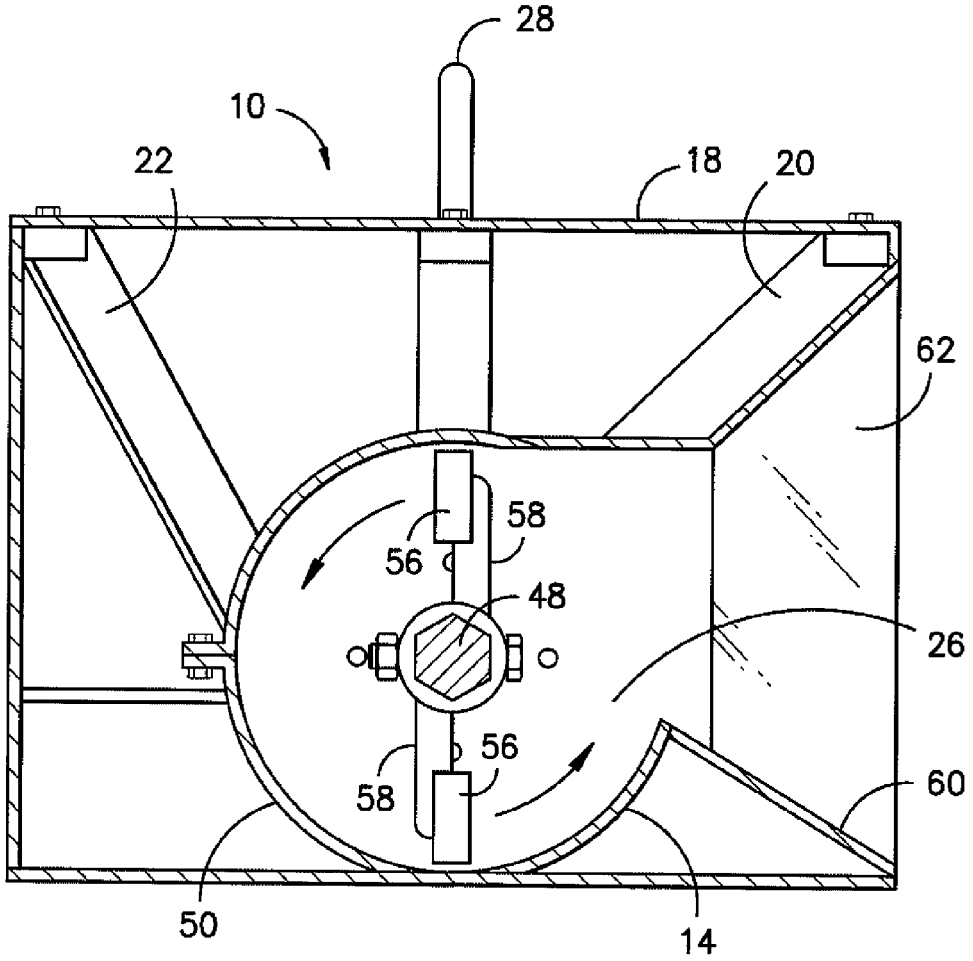
FIG. 5 is a cross-sectional front view of one embodiment of discharge mechanism of a portable modular earth boring machine in accordance with the present invention.

The discharge hopper 26 includes a tubular shaped housing 50, as shown in FIG. 5, and the drive shaft 48 passes through the center of the discharge hopper 26 in an axial orientation, as shown. The discharge hopper 26 is substantially sealed off from the hydraulic drive 24 and the chamber 52 housing the hydraulic drive 24 by a debris shield 54, in order to prevent dirt and debris from entering into the hydraulic drive chamber 52. Discharge paddles 56 are attached to the drive shaft 48 by paddle supports 58, so that the discharge paddles 56 rotate together with the drive shaft 48 during a boring operation. A discharge ramp 60 is positioned adjacent the discharge paddles 56 within the discharge hopper 26, and the discharge ramp 60 extends outwardly toward one side of the drive housing 18, where an open discharge port 62 is located. The drive housing 18 also includes a detachable hopper cover (not shown) adjacent the discharge hopper 26, in order to provide access to the discharge hopper 26 for cleaning and maintenance purposes. The detachable hopper cover may be totally detachable, or may include a hinge and operate like a door.

Additionally, a shift tab 64 is positioned adjacent a rear portion of the drive housing, running angularly down from the rear wall of the drive housing 18 to the skid plate 30. The shift tab 64 provides additional reinforcement and strength between the skid plate 30 and the drive housing 18, and provides a point of attachment, so that the teeth of a backhoe bucket may be placed on either side of the shift tab 64 in order to shift the boring machine, either in a lateral direction or in a longitudinal direction. This arrangement allows an operator (running a backhoe, for instance) to quickly and easily adjust or reposition the boring machine during a boring operation, as necessary.

During operation, the auger 32 spins, boring a horizontal hole in the ground, and pulls the dirt, rocks and rubble toward the discharge hopper 26 through the sleeve 34. When the dirt and rocks enter the drive housing 18 into the discharge hopper 26, the discharge paddles 56 rotate, thereby forcing the dirt and rocks out of the discharge hopper 26 via the discharge ramp 60, which directs the dirt and rock outwardly through a discharge port 62. As the boring operation is underway, any suitable means may be used to push the boring machine 10 inwardly toward the hole that is being bored. For instance, the bucket of a backhoe, or any other type of excavator bucket may be used to push the machine 10. Other means for pushing the machine 10 may include bulldozers, Bobcats or other heavy equipment. One advantage to this arrangement is that it does not require a human worker to be in the hole with the boring machine 10 during the boring operation, which reduces the chances of an accident or injury to the worker. Additionally, because the machine 10 is not physically attached or connected to an excavator or backhoe, the excavator or backhoe need not be tied up for extended periods of time before and after the boring operation for attachment and detachment thereof, thereby making the operation more efficient and less costly.

For purposes of storage and transport, the auger 32 and the sleeve 34 may be removed from the machine 10, and the auger 32 may be stored and transported within the sleeve 34. In this way, it is possible to disassemble the machine 10 so that the component parts may fit on a small trailer, for instance. Any suitable means for removably attaching the auger 32 and sleeve 34 may be employed, particularly if such means provide a quick and easy method for attaching and removing those components from the machine 10.

Although the present invention has been described in considerable detail with reference to certain preferred versions thereof, other versions are possible. Therefore, the spirit and scope of the appended claims should not be limited to the description of the preferred versions contained herein. All features disclosed in this specification may be replaced by alternative features serving the same, equivalent or similar purpose, unless expressly stated otherwise. Thus, unless expressly stated otherwise, each feature disclosed is one example only of a generic series of equivalent or similar features.

We claim:

1. A portable modular earth boring machine comprising:

an outer housing member having an internal frame with supports carried by a skid plate, said supports being used to support a drive member and a discharge hopper;

said outer housing member further including a discharge port for removing dirt and debris from said discharge hopper, and an opening adjacent said discharge hopper;

a drive shaft operatively connected to said drive member, wherein said drive shaft passes through said discharge hopper in an axial orientation;

an auger operatively and removably connected to said drive shaft, whereby said auger is rotatably fixed longitudinally with respect to said skid plate;

a rigid sleeve adapted to be removably received by a fitting around said opening, so that said sleeve is disposed around said auger when said auger is operatively connected to said drive shaft, said sleeve having a diameter that is larger than the diameter of said auger, wherein said skid plate and a bottom portion of said sleeve are in a single linear plane;

discharge paddles operatively connected to said drive shaft within said discharge hopper;

wherein said drive member rotates said drive shaft and said auger; and wherein said auger rotation causes dirt and debris to flow from a distal end of said sleeve into said discharge hopper, where said discharge paddles rotate and eject said dirt and debris through outwardly through said discharge port.

2. The portable modular earth boring machine set forth in claim 1, wherein said outer housing member includes an extraction ring attached to an outer portion thereof.

3. The portable modular earth boring machine set forth in claim 1, wherein said outer housing member includes a detachable hopper cover positioned adjacent said discharge hopper, in order to provide access to said discharge hopper for cleaning, maintenance and repair.

4. The portable modular earth boring machine set forth in claim 1, wherein said auger includes a boring head, said boring head being positioned at a distal end of said auger beyond a distal end of said sleeve during operation, and wherein said boring head has a diameter that is larger than the diameter of said sleeve.

5. The portable modular earth boring machine set forth in claim 1, wherein said outer housing member includes a debris shield positioned between said discharge hopper and said drive member.

6. The portable modular earth boring machine set forth in claim 1, further including a coupling for connecting said drive member to said drive shaft.

7. The portable modular earth boring machine set forth in claim 1, further including a discharge ramp positioned between said discharge hopper and said discharge port for channeling said dirt and debris out of said discharge hopper and outwardly through said discharge port.

8. The portable modular earth boring machine set forth in claim 1, wherein said drive member is a hydraulic drive.

9. The portable modular earth boring machine set forth in claim 1, wherein said drive member is selected from the group consisting of an electric motor, a diesel motor, a gasoline motor, and a pneumatic drive.

10. The portable modular earth boring machine set forth in claim 1, further including a shift tab attached to an upper portion of said skid plate, and further connected to a rear portion of said outer housing member.

11. A portable modular earth boring machine comprising:

an outer housing member having an internal frame with supports carried by a skid plate, said supports being used to support a drive member and a discharge hopper;

said outer housing member further including a discharge port for removing dirt and debris from said discharge hopper, and an opening adjacent said discharge hopper;

a drive shaft operatively connected to said drive member;

an auger operatively and removably connected to said drive shaft;

wherein said drive member rotates said drive shaft and said auger;

an excavating machine with at least one hydraulic port;

hydraulic hoses operatively connected to said hydraulic port, said hydraulic hoses being operatively connected to said drive member so that said excavating machine operates as a power source for said earth boring machine;

a removable rigid sleeve disposed around said auger when said auger is operatively connected to said drive shaft, said sleeve having a diameter that is larger than the diameter of said auger; and wherein said skid plate and a bottom portion of said sleeve are in a single linear plane.

12. The portable modular earth boring machine set forth in claim 11, further including discharge paddles operatively connected to said drive shaft within said discharge hopper.

* * * * *